US012460280B2

(12) United States Patent
Byczynski et al.

(10) Patent No.: US 12,460,280 B2
(45) Date of Patent: Nov. 4, 2025

(54) ALUMINUM CASTING ALLOY, ALUMINUM CAST COMPONENT AND METHOD FOR THE PRODUCTION OF AN ALUMINUM CAST PIECE

(71) Applicant: Nemak, S.A.B. de C.V., Garcia (MX)

(72) Inventors: Glenn Edwin Byczynski, Tecumseh (CA); Abdallah Elsayed, Cambridge (CA); Anthony Marco Lombardi, LaSalle (CA)

(73) Assignee: Nemak, S.A.B. de C.V., Nuevo Leon (MX)

( * ) Notice: Subject to any disclaimer, the term of this patent is extended or adjusted under 35 U.S.C. 154(b) by 163 days.

(21) Appl. No.: 16/910,624

(22) Filed: Jun. 24, 2020

(65) Prior Publication Data

US 2020/0407826 A1 Dec. 31, 2020

(30) Foreign Application Priority Data

Jun. 26, 2019 (EP) ..... 19182661

(51) Int. Cl.
*C22C 21/00* (2006.01)
*C22C 21/02* (2006.01)
(Continued)

(52) U.S. Cl.
CPC ..... *C22C 21/00* (2013.01); *C22C 21/02* (2013.01); *C22C 21/04* (2013.01); *C22C 21/08* (2013.01);
(Continued)

(58) Field of Classification Search
CPC ..... C22C 21/00; C22C 21/02; C22C 21/04; C22C 21/06; C22C 21/08; C22C 21/10;
(Continued)

(56) References Cited

U.S. PATENT DOCUMENTS 4,121,926 A * 10/1978 Ogawa ..... C22C 21/00 420/548
2003/0087123 A1* 5/2003 Benedictus ..... C22F 1/043 428/654
(Continued)

FOREIGN PATENT DOCUMENTS

CN 101724771 A 6/2010
CN 102383009 A 3/2012
(Continued)

OTHER PUBLICATIONS

Wan et al, "Effect of rare earth element Ce on the structure and properties of Al—Mg—Si—Fe alloy", 2015. Proceedings of the Ninth Foundry Technology Conference in Anhul Province. (Year: 2015).*
(Continued)

*Primary Examiner* — Adil A. Siddiqui
(74) *Attorney, Agent, or Firm* — The Webb Law Firm

(57) ABSTRACT

The invention provides an aluminum casting alloy which has the potential for an optimized combination of high mechanical properties and high electric conductivity and which has a high castability as well. The aluminum casting alloy includes (in % by mass), Ce: 0.2-3.0%, Si: 0.5-1.5%, Fe: 0.1-1.2%, Mg: 0.2-1.0%, optionally one or more elements taken from the group "Zn, Sr" the content of the respective optional element being, Zn: 0.8%, Sr: 0.1%, the remainder being Al and unavoidable impurities, said impurities optionally including elements from the group "Ti, Cr, Mn, V" the content of which is restricted in sum to less than 0.025%. The invention also provides an aluminum cast component which has an optimized combination of high mechanical properties and high electric conductivity and a method which allows the reliable production of such aluminum
(Continued)

components from an aluminum alloy according to the invention.

14 Claims, 2 Drawing Sheets

(51) Int. Cl.

| | |
|---|---|
| ***C22C 21/04*** | (2006.01) |
| ***C22C 21/08*** | (2006.01) |
| ***C22F 1/04*** | (2006.01) |
| ***C22F 1/043*** | (2006.01) |
| ***C22F 1/05*** | (2006.01) |

(52) U.S. Cl.
CPC ..... *C22F 1/04* (2013.01); *C22F 1/043* (2013.01); *C22F 1/05* (2013.01)

(58) Field of Classification Search
CPC .. C22F 1/04; C22F 1/043; C22F 1/047; C22F 1/05; C22F 1/053; C22F 1/002; B22D 17/00; B22D 21/04
See application file for complete search history.

(56) References Cited

U.S. PATENT DOCUMENTS

| | | | | |
|---|---|---|---|---|
| 2009/0180920 | A1* | 7/2009 | Reichlinger | C22F 1/053 420/541 |
| 2014/0319956 | A1* | 10/2014 | Wang | B22D 21/007 164/57.1 |
| 2018/0339339 | A1* | 11/2018 | Karlen | B22F 10/28 |

FOREIGN PATENT DOCUMENTS

| | | | | | |
|---|---|---|---|---|---|
| CN | 106216394 | A | | 12/2016 | |
| CN | 107236882 | A | | 10/2017 | |
| CN | 108642347 | A | | 10/2018 | |
| CN | 108715959 | A | | 10/2018 | |
| CN | 108950316 | A | | 12/2018 | |
| JP | 2000212668 | A | * | 8/2000 | C22C 21/00 |

OTHER PUBLICATIONS

Cavallo, "What is a Squirrel Cage Motor and How Does it Work?", 2022. ThomasNet. (Year: 2022).*

"Electrical Steel", Wikipedia, https://en.wikipedia.org/wiki/Electrical_steel, retrieved on Jun. 26, 2020; available before Jun. 26, 2019.

"High pressure die casting", Foundry Lexicon, https://www.giessereilexikon.com/en/foundry-lexicon/Encyclopedia/show/high-pressures-die-casting-4631/?cHash=709c18f2265df2e4b6d0c04aaf887779, retrieved on Jun. 26, 2020; available before Jun. 26, 2019.

"International Annealed Copper Standard", Wikipedia, https://en.wikipedia.org/wiki/International_Annealed_Copper_Standard, retrieved on Jun. 26, 2020; available before Jun. 26, 2019.

"Primary Aluminum Alloys for Pressure Die Casting —Rheinfelden Alloys", Dec. 2015, Rheinfelden Alloys GmbH & Co. KG, Rheinfelden, Germany, GRUPPE DREI® 122015, http:/rheinfelden-alloys.eu/wp-content/uploads/2016/01/05-HB-DG_Ci_Sf_Cm_Td_Ma_RHEINFELDEN-ALLOYS_2015_EN.pdf.

"The International Annealed Copper Standard", NDT Resource Center, https://www.nde-ed.org/GeneralResources/IACS/IACS.htm, retrieved on Jun. 26, 2020; available before Jun. 26, 2019.

"Vacuum-assisted die casting", Foundry Lexicon, https://www.giessereilexikon.com/en/foundry-lexicon/Encyclopedia/show/vacuum-assisted-die-casting-4748/?cHash=d787255a9e2d54fec7b96529360d7c35, retrieved on Jun. 26, 2020; available before Jun. 26, 2019.

Wan et al., Effect of rare earth element Ce on the structure and properties of Al—Mg—Si—Fe alloy, Proceedings of the Ninth Foundry Technology Conference in Anhui Province, Institute of Material Science and Engineering of Hefei Industrial University, Anhui 230009, China, Dec. 13, 2015, pp. 110-114.

Yakubov et al., "Additive manufacturing of crack-free Al-alloy with coarsening-resistant T1-CeAlSi strengthening phase," Materials Science & Engineering A, 2023, vol. 884, pp. 1-15.

* cited by examiner

ALUMINUM CASTING ALLOY, ALUMINUM CAST COMPONENT AND METHOD FOR THE PRODUCTION OF AN ALUMINUM CAST PIECE

CROSS-REFERENCE TO RELATED APPLICATION

This application claims priority to European Patent Application No. 19182661.9 filed Jun. 26, 2020, the disclosure of which is hereby incorporated by reference in its entirety.

BACKGROUND OF THE INVENTION

Field of the Invention

The invention relates to an aluminum casting alloy suited for the production of aluminum cast component used in the manufacturing of electrical drives for vehicles and the like. In addition, the invention relates to an aluminum cast component for an electrical machine and a method for the production of such component as well.

Description of Related Art

The electrical conductivity of components cast from an aluminum alloy usually is expressed as a percentage of the International Annealed Copper Standard (s. https://en.wikipedia.org/wiki/International Annealed Copper Standard or https://www.nde-ed.orq/GeneralResources/IACS/IACS.htm). Thus, if the conductivity of a particular aluminum cast alloy in the as cast state is specified as 40% IACS, that means that the electrical conductivity of a component cast from said aluminum alloy is 40% of the copper specified as the IACS standard after solidifying of the component and without further heat treatment.

A typical example for a component of the kind considered here is the cage of a squirrel cage rotor of an electrical drive for a vehicle. In these rotors an iron core, usually formed by a stack of "electrical steel" sheets (https://en.wikipedia.org/wiki/Electrical_steel), is held in a cage.

In modern machine concepts this cage is made from a lightweight metal alloy to reduce the weight of the rotor.

As a standard for die casting of aluminum components the alloy AlSi10MgMn is known which according to DIN EN 1706 (2010) consists of (in % per mass) 9.5-11.5% Si, ≤0.15% Fe, ≤0.03% Cu, 0.5-0.8% Mn, 0.1-0.5% Mg, ≤0.08% Zn, 0.01-0.02% Sr and 0.04-0.15% Ti, the remainder being Al and ≤0.2% impurities. This known alloy shows an ultimate tensile strength Rm of at least 250 MPa, a yield strength Rp0.2 of at least 120 MPa, a Brinell-hardness of at least 65 HBW and an electric conductivity of 30-40% IACS.

Other conductivity focused aluminum materials for casting of components for electrical applications are the alloy AlSi0, 5Mg ("Anticorodal-04") and pure aluminum rotor alloys, which consists of at least 99.7% by mass of aluminum (s. the brochure "Primary Aluminium Alloys for Pressure Die Casting—RHEINFELDEN ALLOYS" published by RHEINFELDEN ALLOYS GmbH & Co. KG, Rheinfelden, Germany, with the imprint "GRUPPE DREI® 122015", http://rheinfelden-alloys.eu/wp-content/uploads/2016/01/05-HB-DG_Ci_Sf_Cm_Td_Ma_RHEINFELDEN-ALLOYS_2015_EN.pdf).

The aluminum cast alloy AlSi9Sr, which is also disclosed in the brochure of RHEINFELDEN ALLOYS GmbH & Co. KG, has an enhanced electric conductivity of 43.0-48.5% IACS. According to the brochure this alloy consists (in % per mass) of 8.0-9.0% Si, 0.5-0.7% Fe, ≤0.02% Cu, ≤0.01% Mn, ≤0.03% Mg, ≤0.07% Zn, ≤0.01 Ti, 0.01-0.03% Sr, the remainder being Al and up to 0.1% impurities. A component die cast from this alloy has a yield strength Rp0.2 of at least 80 MPa, an ultimate tensile strength of at least 170 MPa and a Brinell-hardness of at least 55 HBW.

In order to increase the efficiency of electrical machines high rotational speeds and large diameters of their components rotating in practical use are sought for. In practice it turns out that components cast from common alloy of the kind indicated above do either not fulfill the strength requirements or do not have an electrical conductivity which is required for an optimum utilization of the electrical drive energy.

Against the background of the prior art explained above, the object of the invention was to develop an aluminum casting alloy which provides the potential for an optimized combination of high mechanical properties and high electric conductivity and which has a high castability as well.

Also, an aluminum cast component should be developed which has an optimized combination of high mechanical properties and high electric conductivity.

Additionally, a method should be created which allows the reliable production of aluminum components which shows an optimized combination of high mechanical properties and high electric conductivity.

SUMMARY OF THE INVENTION

With regard to the aluminum casting alloy, this object has been solved according to the invention in that such an aluminum casting alloy is composed.

With regard to the aluminum cast component the solution of the object referred to above is that such a component is cast from an aluminum casting alloy according to the invention, aluminum cast components according to the invention having an electrical conductivity corresponding to at least 42% IACS, a Brinell-hardness of at least 45 $HB_{10/500}$, a yield strength ("YS") of at least 80 MPa and an ultimate tensile strength ("UTS") of at least 150 MPa.

With regard to the method the object referred to above is solved in that according to the invention during the production of aluminum cast components at least those certain working steps are performed.

Advantageous embodiments of the invention are explained in detail below along with the general notion of the invention.

An aluminum casting alloy according to the invention thus consists of (in % by mass)

| | |
|---|---|
| Ce: | 0.2-3.0% |
| Si: | 0.5-1.5% |
| Fe: | 0.1-1.2% |
| Mg: | 0.2-1.0% |

optionally one or more elements taken from the group "Zn, Sr" the content of the respective optional element being

| | |
|---|---|
| Zn: | ≤0.8% |
| Sr: | ≤0.1% |

the remainder being Al and unavoidable impurities, said impurities optionally including elements from the group "Ti, Cr, Mn, V" the content of which is restricted in sum to less than 0.025%.

Cerium ("Ce") is added to the alloy according to the invention to obtain an improved castability of the alloy. Furthermore, the presence of Ce in the alloy according to the invention reduces grain size in the microstructure of a component cast from the alloy and an improved hardness and other mechanical properties of the component as well. To achieve these effects, at least 0.2% per mass of Ce is needed. Ce-contents higher than 3.0% per mass do not additionally contribute to the enhancement of the properties of the alloy or the component cast from the alloy according to the invention. The positive influences of Ce can be ensured particularly reliably in an aluminum casting alloy according to the invention, if the Ce content amounts to at least 0.3% by mass, especially to at least 0.5% by mass, 0.5-1.5% by mass of Silicon ("Si") and 0.2-1.0% of Magnesium ("Mg") are added to the aluminum alloy according to the invention to strengthen the alloy through the formation of $Mg_2Si$. Furthermore, the existence of Si and Mg makes the alloy according to the invention precipitation hardenable. These positive effects in particular then occur if the Si content of the aluminum casting alloy according to the invention amounts to at least 0.8% by mass and/or the Mg-content amounts to at least 0.4% by mass. An upper limit of the corridor in which an optimized effect of the Si-content present in the aluminum casting alloy according to the invention is to be expected amounts to 1.2% by mass, whereas an optimized effect of the Mg-content present in the aluminum casting alloy according to the invention is to be expected, if the Mg-content is limited to 0.7% by mass.

Iron ("Fe") is added in amounts of 0.1-1.2% by mass to improve castability of the aluminum cast alloy according to the invention and to reduce soldering of the alloy to either the die or the steel laminations to which the Al alloy is cast around. An optimum effect of the presence of Fe in the alloy according to the invention can be achieved by limiting the Fe-content to a maximum of 1.0% by mass.

Zinc ("Zn") can optionally be added in amounts of up to 0.8% by mass to the aluminum cast alloy according to the invention to improve the castability by shifting the Al—Fe eutectic point to a lower Fe concentration, thereby enabling a higher liquid fraction at set temperatures which increased alloy fluidity while filling the die. Zn is also added to increase hardness and strength of the alloy via solution strengthening. To reliably obtain the positive influence of Zn the alloy according to the invention may contain at least 0.1% by mass of Zn.

Strontium ("Sr") can optionally be added in amounts up to 0.1% by mass to the cast alloy according to the invention to increase the strength and reduce die soldering tendencies, specifically in embodiments where the Fe concentration is below 0.5% by mass. To reliably obtain the positive influence of Sr, the alloy according to the invention may contain at least 0.03% by mass of Sr.

Titanium ("Ti"), Chromium ("Cr"), Manganese ("Mn") and Vanadium ("V") may optionally be present in the alloy according to the invention as impurities. However, to avoid significant deterioration of electrical conductivity of the alloy due to even trace amounts of these elements, the sum of the concentrations of Ti, Cr, Mn and V in the cast aluminum alloy according to the invention must be restricted to a total maximum of 0.025% by mass. As already mentioned above, an aluminum cast component for an electrical machine, which is cast from an aluminum casting alloy alloyed in accordance with the invention shows an electrical conductivity corresponding to at least 42% IACS, a Brinell-hardness of at least 45 $HB_{10/500}$, a yield strength ("YS") of at least 80 MPa and an ultimate tensile strength ("UTS") of at least 150 MPa. A cast component according to the invention shows these minimum electrical and mechanical properties in the as cast state ("F-temper") in which the cast component cast does not have undergone a special heat treatment.

An even higher electric conductivity and enhanced mechanical properties can be achieved by heat treating the aluminum component in accordance with the invention. It turns out, that aluminum cast components formed from the aluminum alloy according to the invention show an electrical conductivity of at least 45% IACS, especially at least 47% IACS, in the T5-tempered state (i.e. after being cooled from the cast temperature and then artificially aged) or, at least 48% IACS in the T6/T7-tempered state (i.e. after being solution heat treated then artificially aged to either peak or overaged condition).

The Brinell-hardness of the aluminum cast component was measured at a temperature of 25° C. in accordance with the ASTM E10-18 standard, which for aluminum alloys involves using a 10 mm hardened steel ball indenter and 500 kg load. Regularly, the Brinell hardness of the aluminum cast components according to the invention amounts not only to at least 40 $HB_{10/500}$, but to 42 $HB_{10/500}$ or more, especially at least 45 $HB_{10/500}$ or at least 46 $HB_{10/500}$. After a natural aging of up to ten days after the casting the Brinell hardness of the aluminum cast components according to the invention raises to at least 50 $HB_{10/500}$. A Brinell hardness of 50-52 $HB_{10/500}$ could reliably be achieved by natural aging. Increased natural aging time did not have a significant influence on Brinell hardness. By artificially aging the aluminum cast components (T5 condition) according to the invention the Brinell hardness can be further raised to at least 52 $HB_{10/500}$. By employing a solution heat treatment followed by artificial aging (T6/T7 temper) to the cast aluminum components, the hardness can be further raised to at least 55 $HB_{10/500}$.

The yield strength ("YS"), the ultimate tensile strength ("UTS") and the total elongation ($EL_T$) at fracture of the aluminum cast components according to the invention were measured at a temperature of 25° C. and strain rate of 1 mm/min in accordance with the ASTM B557 standard.

In the as cast state (F condition) the yield strength (YS) of an aluminum component according to the invention is at least 80 MPa. After an artificial aging (T5 condition) the aluminum cast components according to the invention regularly show a yield strength of at least 115 MPa in the T5 condition. By an T6/T7 heat treatment the yield strength of aluminum cast components according to the invention can further be improved.

Aluminum cast components according to the invention exhibit an ultimate tensile strength (UTS) of at least 150 MPa independently, if and which heat treatment they underwent. Ultimate tensile strengths of at least 160 MPa can regularly be achieved.

The total elongation ($EL_T$) at fracture for the aluminum cast components according to the invention amounts to at least 8% in the F-temper and at least 6% in the T5 condition for round tensile specimen. For the flat tensile specimen, the total elongation at fracture amounts to at least 14-16% in the F-temper condition and to at least 9% in the T5 temper condition. The difference in elongation is attributed to a larger portion of the cross-section being comprised of the rapidly solidified skin for the flat bars (geometry factors), reducing the overall defects and porosity in the cross-section.

The combination of high electric conductivity and optimized mechanical properties make the aluminum alloy according to the invention especially suited for the manufacture of cast components for electric applications in which they are exposed to high centrifugal forces. Accordingly, an aluminum cast component according to the invention preferably is a cage for a squirrel cage rotor, in which the "electrical steel" components of the rotor are inserted into the die prior to the high pressure die casting of the molten Al alloy.

According to the invention, the method for the production of an aluminum cast component comprises at least the following working steps:

a) providing an aluminum casting alloy melt alloyed in accordance with the invention;
b) casting the aluminum cast component from the aluminum casting alloy provided in working step a);
c) air cooling of the aluminum cast component;
d) optionally: heat treating the aluminum cast component obtained in working step c);
e) optionally: naturally aging of the aluminum cast component for up to 10 days.

As a matter of course, the skilled expert will supplement all work steps which are not mentioned here, but of which he knows from the prior art that they are necessary for the production of a casting and for the heat treatments carried out optionally as well.

In working step b) the casting is performed as high pressure die casting ("HPDC"), which optionally is assisted by application of vacuum ("VAHPDC"). Its optimized castability makes an aluminum melt alloyed in accordance with the invention especially suited for these casting processes which are well established in practice for the mass production of castings with sophisticated designs (for the High pressures die casting ("HPDC") see https://www.giessereilexikon.com/en/foundry-lexicon/Encyclopedia/show/high-pressures-die-casting-4631/?cHash=709c18f2265df2e4b6d0c04aaf887779 and for the Vaccum-assisted die casting ("VAHPDC") see https://www.giessereilexikon.com/en/foundry-lexicon/Encyclopedia/show/vacuum-assisted-die-casting-4748/?cHash=d787255a9e2d54fec7b96529360d7c35).

The cooling of the aluminum cast piece component which is performed as working step c) in the course of the method according to the invention can be carried out as cooling under still air or as forced air cooling in which the cast component is exposed to an air stream resulting in a cooling rate of 200-400° C./min in the cast aluminum piece.

As explained above, by heat treating the aluminum cast components produced in accordance with the invention can be enhanced by heat treating them. Thus, optionally in working step d) the heat treatment of the aluminum cast component can be performed as a T5 tempering (i.e. an artificial aging at an aging temperature Ta of 200-240° C. for an aging time ta of 1.5-3.0 hours. In practice an aging temperature Ta of 210-220° C. and an aging time ta of 2 hours can be appropriate.

As an alternative the optional heat treatment according to working step d) can be performed as an T6/T7 tempering in the course of which the aluminum cast component is solution heat treated at a solution heat treatment temperature Ts of 475-520° C. over a solution heat treatment time ts of 0.5-1.0 hours, cooled by forced air quenching during which the aluminum cast piece is exposed to an air stream resulting in a cooling rate of 200-400° C./min in the cast aluminum piece, and artificially aged at an aging temperature Ta of 200-240° C. for an aging time ta of 1.5-3.0 hours. In practice a solution heat treatment temperature Ts of 485-515° C. and a solution heat treatment time ts of 0.5-1 hour, an aging temperature Ta of 210-220° C. and an aging time of 2 hours can be appropriate.

BRIEF DESCRIPTION OF THE DRAWINGS

Below, the invention is explained in more detail by means of exemplary embodiments. Herein are shown.

DESCRIPTION OF THE INVENTION

Three aluminum casting alloys according to the invention Al-1.1Si-0.6Mg-2.7Ce, Al-0.6Fe-0.9Si-0.5Mg-0.7Ce, Al-1Fe-0.8Si-0.5Mg-0.6Zn-0.5Ce were melted, the compositions of which are specified in Table 1.

As test specimens flat and round test bars were cast in a common High Pressure Die Casting device from the alloys Al-1.1Si-0.6Mg-2.7Ce, Al-0.6Fe-0.9Si-0.5Mg-0.7Ce, Al-1Fe-0.8Si-0.5Mg-0.6Zn-0.5Ce under common conditions. The test specimens cast were representative for the aluminum cast components the aluminum cast alloy according to the invention is designed for.

After casting the test specimen were cooled to room temperature under still air.

Figure 1:
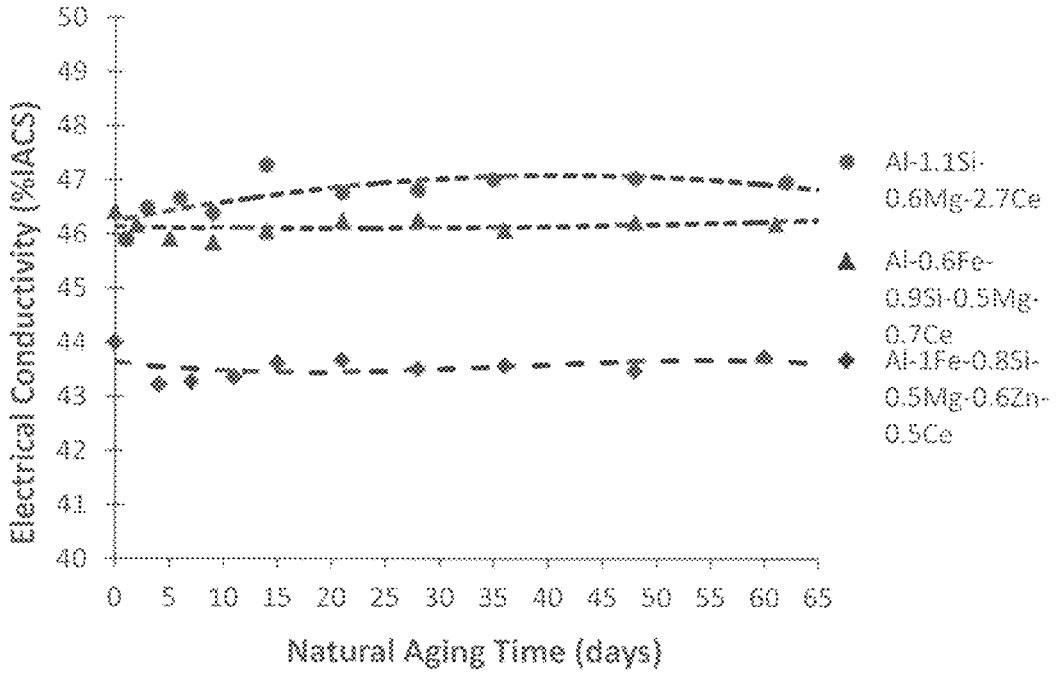
FIG. 1 a diagram which shows the electrical conductivity variation with natural aging time for three aluminum alloys according to the invention.

In a first trial the influence of the natural aging on the electrical conductivity of the specimens in the as cast state (F-temper) was examined. The results of these trials are shown in FIG. 1. It turned out that natural aging does not have a significant effect on the electrical conductivity.

Figure 2:
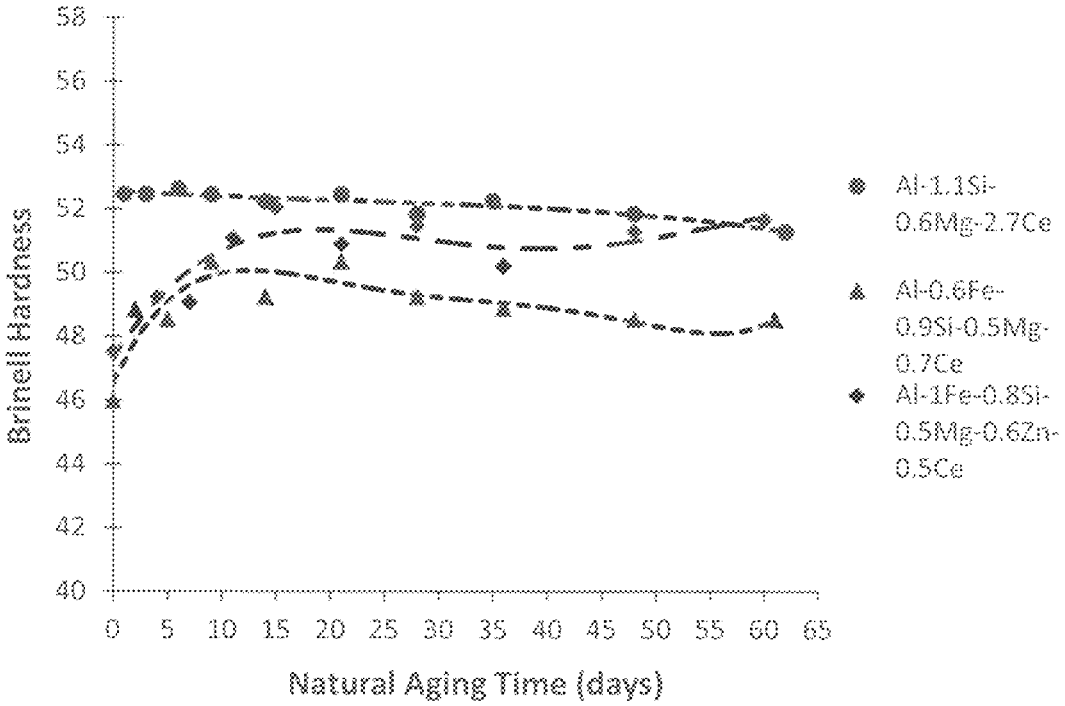
FIG. 2 a diagram which shows the variation in Brinell hardness with natural aging time for the three aluminum alloys according to the invention.

However, as shown in FIG. 2, especially the Brinell-hardness of the test specimen which was cast from the aluminum cast alloys Al-0.6Fe-0.9Si-0.5Mg-0.7Ce and Al-1Fe-0.8Si-0.5Mg-0.6Zn-0.5Ce with the lower Ce-content significantly rises in the course of the natural aging within an aging time of up to 10 days. FIG. 2 also shows that an increased natural aging time did not contribute to a further significant raise of the Brinell-hardness.

Figure 3:
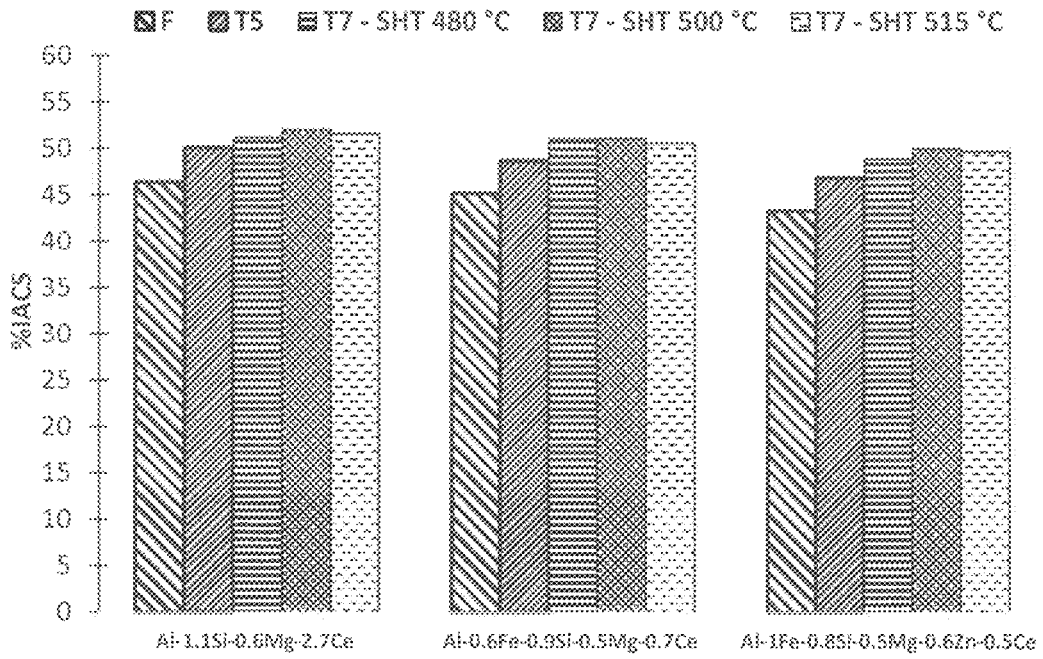
FIG. 3 a diagram which shows the electrical conductivity changes due to heat treatment for the three aluminum alloys according to the invention.

In a second trial the influence of a T5 heat treatment was examined. For that the test specimen were heated to an artificial aging temperature of 210-220° C. and held in this temperature range for 2 hours. Subsequently the electrical conductivity of the test specimen artificially aged in this way was determined. In FIG. 3 the electrical conductivity of the specimen obtained by the T5 heat treatment are opposed to the respective electrical conductivity measured for the test specimen which underwent a natural aging of 60 days (F temper). It turns out that by the artificial aging (T5 heat treatment) a significant raise of the electrical conductivity can be obtained. This is especially true in the alloys Al-1.1Si-0.6Mg-2.7Ce and Al-0.6Fe-0.9Si-0.5Mg-0.7Ce which have higher Ce contents of at least 0.7% by mass respectively.

In a third trial test specimen cast from the three cast alloys underwent three variants of a T7-treatment. In the first variant, the respective specimens were solution heat treated at a solution heat treatment temperature Ts of 480° C. In the second variant the solution heat treatment temperature Ts was 500° C. and in the third variant the solution heat treatment temperature Ts was 515° C. Each of the specimens were held for a solution heat treatment time is of 0.5 hours at the respective solution heat treatment temperature Ts (not including heat-up time). After the solution heat treatment the specimens were forced air cooled with a cooling rate of 100° C./min. Subsequently, each of the specimens underwent artificial aging at an aging temperature Ta of 215° C. for an aging time to of 2 hours. The trials confirmed that by a T7 heat treatment the electrical conductivity of components cast from the alloys according to the invention can further be improved.

Figure 4:
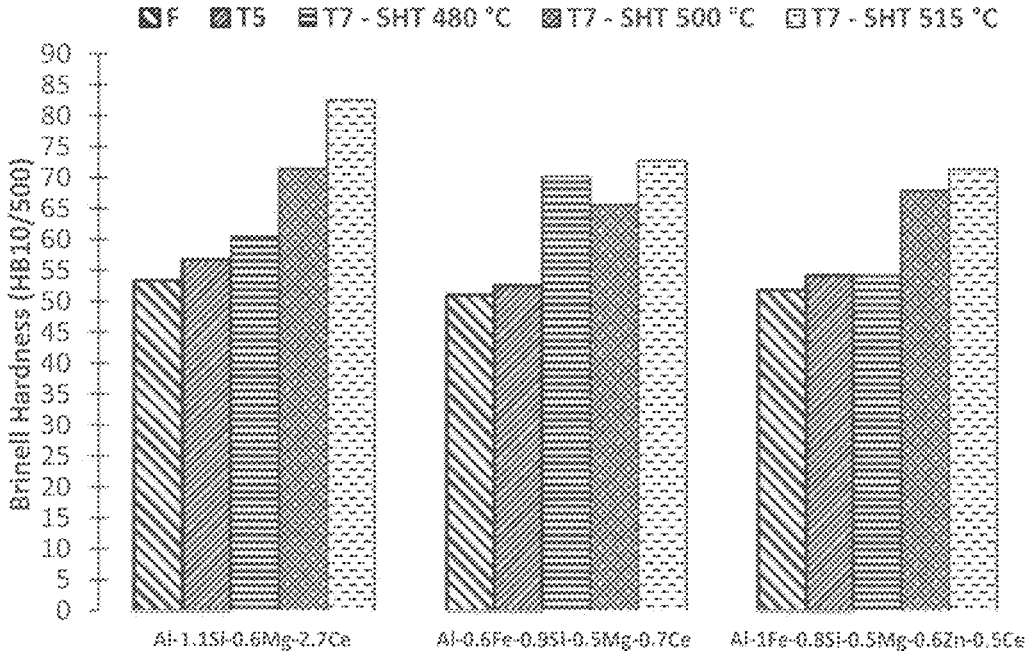
FIG. 4 a diagram which shows the Brinell hardness changes due to heat treatment for the three aluminum alloys according to the invention.

Furthermore, the Brinell-hardness of the test specimens which underwent the T5 and the T7 heat treatments was measured and compared with the Brinell-hardness of the test specimens which underwent the 60 days natural aging (F-temper). The result of this comparison is shown in FIG. 4. It shows that also the Brinell-hardness can be significantly enhanced by heat treating the cast components made from the alloy according to the invention. Especially the specimens, which were solution heat treated with a solution heat treatment temperature Ts of 515° C., exhibit a maximized Brinell-hardness. Subsequently, the yield strength YS, the ultimate tensile strength UTS and the elongation at fracture $EL_T$ were measured for the tests specimens in the as cast state (F-tempered) and after the T5 heat treatment (T5-tempered). In Table 2 the results of these measurements examined on the round bar test specimen are indicated. In Table 3 the results of these measurements examined on the flat bar test specimen are indicated.

TABLE 1

| Alloy | Ce | Si | Fe | Mg | Zn |
|---|---|---|---|---|---|
| Al—1.1Si—0.6Mg—2.7Ce | 2.7 | 1.1 | 0.1 | 0.6 | — |
| Al—0.6Fe—0.9Si—0.5Mg—0.7Ce | 0.7 | 0.9 | 0.6 | 0.5 | — |
| Al—1Fe—0.8Si—0.5Mg—0.6Zn—0.5Ce | 0.5 | 0.8 | 1.0 | 0.6 | 0.6 |

Specifications in % by mass, Remainder Al and unavoidable impurities

TABLE 2

| Alloys | F-Temper YS [MPa] | F-Temper UTS [MPa] | F-Temper $EL_T$ [%] | T5 Temper YS [MPa] | T5 Temper UTS [MPa] | T5 Temper $EL_T$ [%] |
|---|---|---|---|---|---|---|
| Al—1.1Si—0.6Mg—2.7Ce | 88 | 175 | 9.7 | 123 | 179 | 6.2 |
| Al—0.6Fe—0.9Si—0.5Mg—0.7Ce | 83 | 159 | 9.4 | 115 | 170 | 7.7 |
| Al—1Fe—0.8Si—0.5Mg—0.6Zn—0.5Ce | 89 | 167 | 8.1 | 126 | 177 | 6.1 |

TABLE 3

| Alloys | F-Temper YS [MPa] | F-Temper UTS [MPa] | F-Temper $EL_T$ [%] | T5 Temper YS [MPa] | T5 Temper UTS [MPa] | T5 Temper $EL_T$ [%] |
|---|---|---|---|---|---|---|
| Al—1.1Si—0.6Mg—2.7Ce | 87 | 176 | 14.1 | 118 | 174 | 9.9 |
| Al—0.6Fe—0.9Si—0.5Mg—0.7Ce | 81 | 162 | 14.8 | 115 | 167 | 10.5 |
| Al—1Fe—0.8Si—0.5Mg—0.6Zn—0.5Ce | 89 | 176 | 15.5 | 124 | 175 | 9.4 |

The invention claimed is:

1. An aluminum cast component being cast from an aluminum component casting alloy consisting of, in % by mass:

| | |
|---|---|
| Ce: | 0.7-3.0% |
| Si: | 0.5-1.5% |
| Fe: | 0.1-1.2% |
| Mg: | 0.2-1.0% |

optionally one or more elements taken from the group consisting of Zn and Sr, the content of the respective optional element being Zn: ≤0.8%

Sr: ≤0.1%, and the remainder being Al and unavoidable impurities, said unavoidable impurities including elements from the group consisting of Ti, Cr, Mn, and V, the content of said unavoidable impurities restricted in sum to less than 0.025%, wherein the aluminum cast component in the as cast state (F-Temper) has an electrical conductivity of at least 42% IACS, a Brinell-hardness of at least 45 $HB_{10/500}$, a yield strength ("YS") of at least 80 MPa, and an ultimate tensile strength ("UTS") of at least 150 MPa.

2. The aluminum cast component according to claim 1, characterized in that the minimum Ce-content of the aluminum component casting alloy amounts to 2.7% by mass.

3. The aluminum cast component according to claim 1, characterized in that the minimum Si-content of the aluminum component casting alloy amounts to 0.8% by mass.

4. The aluminum cast component according to claim 1, characterized in that the maximum Fe-content of the aluminum component casting alloy amounts to 1.0% by mass.

5. The aluminum cast component according to claim 1, characterized in that the minimum Zn-content of the aluminum component casting alloy amounts to 0.1% by mass.

6. The aluminum cast component according to claim 1, characterized in that its electrical conductivity corresponds to at least 45% IACS.

7. The aluminum cast component according to claim 1, characterized in that its yield strength ("YS") amounts to at least 115 MPa.

8. The aluminum cast component according to claim 1, characterized in that it is a cage for a squirrel cage rotor.

9. A method for the production of an aluminum cast component according to claim 1 comprising the following working steps:

a) providing an aluminum component casting alloy melt alloyed in accordance with claim 1;

b) casting the aluminum cast component from the aluminum component casting alloy provided in working step a);

c) air cooling of the aluminum cast component;

d) optionally: heat treating the aluminum cast component obtained in working step c);

e) optionally: naturally aging of the aluminum cast component for up to 10 days.

10. The method according to claim 9, characterized in that in working step b) the casting is performed as high pressure die casting ("HPDC"), which optionally is assisted by application of vacuum ("VAHPDC").

11. The method according to claim 9, characterized in that in working step c) for the air cooling the aluminum cast component is exposed to still air.

12. The method according to claim 9, characterized in that in working step c) for the air cooling the aluminum cast component is exposed to an air stream resulting in an average cooling rate of 200-400° C./min in the cast aluminum component.

13. The method according to claim 9, characterized in that in working step d) the heat treatment of the aluminum cast component is performed as artificial aging at an aging temperature Ta of 200-240° C. for an aging time ta of 1.5-3.0 hours.

14. The method according to claim 12, characterized in that in working step d) the heat treatment of the aluminum cast component is performed as solution heat treatment at a solution heat treatment (SHT) temperature Ts of 475-520° C. for a solution heat treatment time ts of 0.5-1.0 hours followed by forced air quenching, during which the aluminum cast piece is exposed to an air stream resulting in an average cooling rate of 200-400° C./min in the cast aluminum piece, and an artificial aging at an aging temperature Ta of 200-240° C. for an aging time ta of 1.5-3.0 hours.

* * * * *